US009613727B2

(12) United States Patent
Haaland et al.

(10) Patent No.: US 9,613,727 B2
(45) Date of Patent: Apr. 4, 2017

(54) QUASI-NEUTRAL PLASMA GENERATION OF RADIOISOTOPES

(71) Applicant: MICROPET, INC., San Francisco, CA (US)

(72) Inventors: Peter Haaland, Fraser, CO (US); Konstantinos (Dennis) Papadopoulos, Chevy Chase, MD (US); Arie Zigler, Potomac, MD (US)

(73) Assignee: MICROPET, INC., San Francisco, CA (US)

( * ) Notice: Subject to any disclaimer, the term of this patent is extended or adjusted under 35 U.S.C. 154(b) by 15 days.

(21) Appl. No.: 14/242,621

(22) Filed: Apr. 1, 2014

(65) Prior Publication Data

US 2014/0326900 A1 Nov. 6, 2014

Related U.S. Application Data

(60) Provisional application No. 61/807,218, filed on Apr. 1, 2013.

(51) Int. Cl.

| | |
|---|---|
| ***H05G 2/00*** | (2006.01) |
| ***G21G 1/00*** | (2006.01) |
| ***G21G 1/10*** | (2006.01) |
| ***G21G 1/12*** | (2006.01) |

(52) U.S. Cl.

CPC ..... *G21G 1/001* (2013.01); *G21G 1/10* (2013.01); *G21G 1/12* (2013.01); *G21G 2001/0094* (2013.01)

(58) Field of Classification Search

CPC ..... H01J 49/00; H01J 49/02; H01J 49/105; H01H 1/36

USPC ..... 250/492.1, 504 R, 281, 282, 288, 423 R, 250/424, 425, 426

See application file for complete search history.

(56) References Cited

U.S. PATENT DOCUMENTS

| | | | | |
|---|---|---|---|---|
| 6,095,084 | A * | 8/2000 | Shamouilian | C23C 16/00 118/723 E |
| 7,829,032 | B2 | 11/2010 | Van Dam et al. | |
| 8,080,815 | B2 | 12/2011 | Nutt | |
| 2002/0044629 | A1* | 4/2002 | Hertz | G03F 7/70033 378/119 |
| 2002/0090194 | A1* | 7/2002 | Tajima | H05H 15/00 385/147 |
| 2002/0172317 | A1 | 11/2002 | Maksimchuk et al. | |

(Continued)

FOREIGN PATENT DOCUMENTS

| | | |
|---|---|---|
| EP | 1569243 | 8/2005 |
| EP | 1617713 | 1/2006 |

OTHER PUBLICATIONS

Katzir et al., A Plasma Microlens for Ultrashort High Power Lasers, Jul. 20, 2009, Applied Physics Letters, 95.*

(Continued)

*Primary Examiner* — Jason McCormack

(74) *Attorney, Agent, or Firm* — Michael Best & Friedrich LLP

(57) ABSTRACT

Methods and apparatus for synthesizing radiochemical compounds are provided. The methods include generating a quasi-neutral plasma jet, and directing the plasma jet onto a radionuclide precursor to provide one or more radionuclides. The radionuclides can be used to prepare radiolabeled compounds, such as radiolabeled biomarkers.

19 Claims, 10 Drawing Sheets

(56) References Cited

U.S. PATENT DOCUMENTS

| | | | | |
|---|---|---|---|---|
| 2006/0017023 | A1* | 1/2006 | Taylor | B82Y 10/00 250/504 R |
| 2006/0104401 | A1 | 5/2006 | Jongen et al. | |
| 2006/0193997 | A1* | 8/2006 | Bykanov | B82Y 10/00 427/585 |
| 2008/0298401 | A1* | 12/2008 | Faure | A61N 5/1084 372/18 |
| 2010/0127188 | A1 | 5/2010 | Nutt | |
| 2010/0181503 | A1* | 7/2010 | Yanagida et al. | 250/504 R |
| 2010/0218896 | A1* | 9/2010 | Ai | C23C 16/452 156/345.43 |
| 2010/0282978 | A1* | 11/2010 | Norling | H05H 13/00 250/396 ML |
| 2011/0170079 | A1* | 7/2011 | Banine | G03F 7/70175 355/30 |
| 2013/0182807 | A1* | 7/2013 | Wilson | G21G 1/02 376/108 |

OTHER PUBLICATIONS

Aluaddin, "Positron emission tomography (PET) imaging with 18F-based radiotracers," Am J Nucl Med Mol Imaging 2012;2(1):55-76.

Borghesi et al., "Multi-MeV Proton Source Investigations in Ultraintense Laser-Foil Interactions," Phys Rev Lett., 92, 055003-1-4, (2004).

Bruijnen et al., "Present Role of Positron Emission Tomography in the Diagnosis and Monitoring of Peripheral Inflammatory Arthritis: A Systematic Review," Arthritis Care & Research vol. 66, No. 1, Jan. 2014, pp. 120-130.

Buffechoux et al, "Hot Electrons Transverse Refluxing in Ultraintense Laser-Solid Interactions," Physical Review Letters 105, 015005, 2010.

Ceccotti et al., "Proton Acceleration with High-Intensity Ultrahigh-Contrast Laser Pulses," Physical Review Letters, 99, 185002, 2007.

Fuchs et al., "Laser-driven proton scaling laws and new paths towards energy increase," Nature Physics, 2, 48 2006, 48-54.

Kaluza et al., "Influence of the Laser Prepulse on Proton Acceleration in Thin-Foil Experiments," Phys. Rev. Lett., 93, 045003-1-4 (2004).

Katzir Yiftach et al: "A plasma microlens for ultrashort high power lasers", Applied Physics Letters, American Institute of Physics, US, vol. 95, No. 3, Jul. 20, 2009, pp. 31101-1-31101-3.

Laking et al., "Positron emission tomographic imaging of angiogenesis and vascular function," The British Journal of Radiology, 76 (2003), S50-S59.

Mackinnon et al., "Effect of Plasma Scale Length on Multi-MeV Proton Production by Intense Laser Pulses," Physical Review Letters 86,1769-1772, 2001.

Monot et al., "High-order harmonics generation by non-linear reflection of an intense high-contrast laser pulse on a plasma," Optics Letters, 29, 893-895, 2004.

Nakatsutsumi et al., "Fast focusing of short-pulse lasers by innovative plasma optics toward extreme intensity," Optics Letters 35, 2314-2316, 2010.

Sgattoni et al., "Laser ion acceleration using a solid target coupled with a low-density layer," Physical Review E85,036405-1-9, 2012.

Snavely et al. "Intense High-Energy Proton Beams from Petawatt-Laser Irradiation of Solids," Phys. Rev. Lett., 85, 2945-2948, 2000.

Macchi, "A Superintense Laser-Plasma Interaction Theory Primer," Springer Briefs in Physics, (New York:Springer Verlag, 2013).

Sylla et al., "Development and characterization of very dense submillimetric gas jets for laser-plasma interaction," Review of Scientific Instruments, 83, 033507-1-7, 2012.

International Search Report and Written Opinion for PCT/US2014/032566 dated Jul. 15, 2014, 13 pages.

Mukherjee, "Optimisation of the Radiation Shielding of Medical Cyclotrons using a Genetic Algorithm", pp. 1-11, P-9-111, Safety Division (B55), Australian Nuclear Science and Technology Organisation (ANSTO), Menai, NSW Australia.

Le Goff, "A very low energy cyclotron for PET isotope production", Technology and innovation workshop European Physical Society (EPS), Oct. 22-24, 2012, pp. 1-30, CERN European Organization for Nuclear Research.

* cited by examiner

QUASI-NEUTRAL PLASMA GENERATION OF RADIOISOTOPES

CROSS REFERENCE TO RELATED APPLICATION

This application claims the benefit of priority to U.S. Provisional Application No. 61/807,218, filed Apr. 1, 2013, which is herein incorporated by reference in its entirety.

TECHNICAL FIELD

The present disclosure relates generally to devices and methods for synthesizing radionuclides, and more particularly, to the use of a quasi-neutral plasma jet for the synthesis of radionuclides.

BACKGROUND

Positron emission tomography (PET) is a method of imaging that uses radiolabeled probe molecules to target, detect, and quantify biological processes in vivo. PET techniques are used to study disease mechanisms, to develop new diagnostic and therapeutic methods, to detect early stage disease, and to monitor responses to therapies. The equipment, infrastructure, and personnel currently required to produce PET probes severely constrain the availability and diversity of probes, hindering advances in disease diagnosis, therapy, and medical research that requires this imaging method.

The approach to synthesis of biochemical compounds with radioactive nuclei generally starts with a charged particle accelerator. Particle accelerators have the following attributes: an ion source, electrostatic extraction optics that select a single polarity of ion for acceleration, electromagnetic fields to accelerate and focus the ions, a vacuum chamber to prevent elastic and inelastic scattering of the ion beam, collimation apertures, and external shielding to protect operators and electronics from neutron and ionizing radiation produced in the accelerator. Referring to FIG. 1, positive or negative ions are formed in an ion source (101), typically by electron impact, then separated by polarity (anions from cations) and mass (atomic ions from molecular ions and electrons) and accelerated in a linear or cyclotron accelerator (102) with electromagnetic fields to increase their kinetic energy. The charged beam is then extracted from the accelerator (103), collimated, and shaped using electrostatic lenses. Approximately 20% of the beam current is lost in the cyclotron, contaminating the housing with heavy radioactive nuclei and neutron radiation. Extraction of negative ions such as $^{1}H^{-}$ is also accomplished with electrostatic fields. These anions must then be converted to protons by passing them through a carbon foil to strip two electrons with almost 100% efficiency. Since energetic negative ions do not undergo nuclear reactions with the metallic accelerator components and the reactive positive ion beam has a short path, activation of the housing is reduced. However, the acceleration of negative ions requires ultra high vacuum ($<10^{-10}$ atmospheres) to mitigate charge neutralization. The acceleration of all charged species also produces electromagnetic radiation; at the energies required for subsequent formation of radionuclides, this is ionizing radiation that requires heavy, bulky shielding (104) for safe operation.

Effective formation and acceleration of ions by electromagnetic fields requires operation in vacuum chamber (105), so the next step impinges the energetic ion flux through a window material (105) and onto a solid, liquid, or gas precursor material (106). The energetic ions convert some of the precursor (106) to radionuclides (107) by nuclear reactions. The mixture of precursor and radionuclides (106, 107) are transferred (108) to a separately shielded (109) hot cell or microfluidic reactor where chemical reactions (110) and purifications (111) convert the radionuclide into an injectable radiochemical reagent.

The collision of the accelerated ions with the precursor material occasionally results in a nuclear reaction whose probability is quantified as the integral of the product of a cross-section Q(E), the energy distribution of the ion flux (f(E)), and the relative velocity of the ion and precursor nuclei (v(E)). The rate of radionuclide (RN) production from a concentration of precursor is given by $$\frac{d[RN]}{dt} = [\text{Precursor}] * \int Q(E) * f(E) * v(E) dE \quad \text{(Eq 1)}$$

These nuclear reactions yield an unstable material that decays by releasing a positron, which in turn collides with an ambient electron to produce two counter-propagating gamma rays. The gamma rays are then recorded by coincidence detection in a toroidal sensor. Following tomographic inversion the location of the decaying radionuclide can be determined to within fractions of a millimeter. PET imaging has been applied to the diagnosis of vascular function (Laking et al., *The British Journal of Radiology,* 76 (2003), S50-S59 E), arthritis (Bruijnen et al., Arthritis Care & Research Vol. 66, No. 1, January 2014, pp 120-130), and tumerogenesis (Aluaddin, Am J Nucl Med Mol Imaging 2012;2(1):55-76), among many others.

The specific activity (SA) of a radioactive tracer is an important figure of merit for a PET reagent. It is defined as the intensity of radiation divided by the mass or number of moles of material, and it decreases with time (t) according to the expression $\exp(-t/\tau)$ where the decay rate ($1/\tau$) is a fundamental property of the specific radionuclide. This decay begins the moment a radionuclide is formed, and extensive research has been devoted to methods of swiftly and efficiently inserting the radionuclide into a biological probe through chemical reactions and purifications to produce a PET reagent in the shortest possible times.

Representative values of $\tau$ are listed in table I. Small values of $\tau$ imply rapid decay, which is advantageous because it produces more decay events per second and therefore greater signal to noise ratios when collecting image data. However, for these same values of $\tau$ any factor that increases t leads to a faster loss of potency of the reagent.

TABLE I

Properties of four representative medical isotopes that are produced by proton bombardment.

| Medical Isotope | Decay time ($\tau$) minutes | Nuclear Reaction | Energy (MeV) | Yield (milliCi @ sat) |
|---|---|---|---|---|
| $^{11}C$ | 29.3 | $^{11}B$ (p, n) | 8-20 | 40/μA |
| $^{11}C$ | 29.3 | $^{14}N$ (p, α) | 12 | 100/μA |
| $^{13}N$ | 14.4 | $^{13}C$ (p, n) | 5-10 | 115/μA |
| $^{13}N$ | 14.4 | $^{16}O$ (p, α) | 8-18 | 65/μA |
| $^{15}O$ | 2.94 | $^{15}N$ (p, n) | 4-10 | 47/μA |
| $^{15}O$ | 2.94 | $^{16}O$ (p, pn) | >26 | 25/μA |
| $^{18}F$ | 158 | $^{18}O$ (p, n) | 8-17 | 180/μA |

One problem with the current methods is their requirement for an accelerator or cyclotron to produce the ion beam from which radionuclides are formed. Cyclotrons require heavy and expensive magnets, high voltages, substantial electric power, and extensive radiation shielding. For example, Bhaskar Mukherjee has summarized the shielding requirements in *Optimisation of the Radiation Shielding of Medical Cyclotrons using a Genetic Algorithm*, which is incorporated herein by reference in its entirety. According to Mukherjee, "[t]he important radioisotopes produced by Medical Cyclotrons for present day diagnostic nuclear medicine include $^{201}$T1 ($T_{1/2}$=73.06 h) and $^{67}$Ga ($T_{1/2}$=78.26 h). These radioisotopes are generated by bombarding the thick copper substrates electroplated with enriched parent target materials with 30 MeV protons at ~400 μA beam current. The target bombardments result in the production of intense fields of high-energy neutrons and gamma rays." A summary of medical cyclotron characteristics abstracted from a presentation by Jean-Marie Le Goff, [*A very low energy cyclotron for PET isotope Production*, European Physical Society Technology and Innovation Workshop Erice, 22-24 Oct. 2012] is reproduced in Table II. As can be seen with reference to Table II, the average weight of a medical cyclotron is 36 tons, the average weight required for shielding is 47 tons, and the average power requirement is 101 kilowatts. The smallest device in Table II has a total weight of ten tons and requires 10 kW of power. In other words, the size, weight, and power of a cyclotron require that it be placed in a fixed installation.

TABLE II

Parameters including size, weight, and power of some commercial cyclotrons that are used for medical isotope production.

| Company Name | Cyclotron Model | Particles | Eao:rgy (MeV) | Beam Current (μA) | Ion Source | RF Frequ. (MHz) | Cycltron Weight (tons) | Shield Weight (tons) | Power (kW) |
|---|---|---|---|---|---|---|---|---|---|
| ACSI | TR14 | H− | 14 | >100 | Cusp | 74 | 22 | 40 | 60 |
| ACSI | TR19(9) | H−(D−) | 19, 9 | >300 (100) | Cusp | 74 (37) | 22 | | 65 |
| ACSI | TR24 | H− | 24 | >300 | Cusp | 83.5 | 84 | | 80 |
| ACSI | TR30(15) | H−, (D−) | 30, 15 | 1500 (400) | Cusp | | 56 | | 150 |
| ABT | Tabletop | H+ | 7.5 | 5 | PIG | 72 | 3.2 | 7.6 | 10 |
| Best | BSCI 14p | H• | 14 | 100 | PIG | 73 | 14 | | 60 |
| Best | BSCI 35p | H− | 15-35 | 1500 | Cusp | 70 | 55 | | 280 |
| Best | BSCI 70p | H− | 70 | 800 | Cusp | 58 | 195 | | 400 |
| CIAE | CYCCIAE14 | H− | 14 | 400 | Cusp | | | | |
| CIAE | CYCCJAE70 | H− | 70 | 750 | Cusp | | | | |
| NIIEFA | CC-18/9 | H−, (D−) | 18, 9 | 100 (50) | Cusp | 38.2 | 20 | | Feb-00 |
| EUROMEV | Isotrace | H• | 12 | 100 | Cusp | 108 | 3.8 | | 40 |
| GE | MINItrace | H− | 9.6 | >50 | PIG | 101 | 9 | 40 | 35 |
| GE | PETtrace | H−, (D−) | 16.5, 18.6 | >100 (6.5) | PIG | 27 | 22 | 47 | 70 |
| IBA | Cyclone 3 | D+ | 3.8 | 60 | PIG | 14 | 5 | | 14 |
| IBA | Cyclone10/5 | H−, (D−) | 10, 5 | >100 (35) | PIG | 42 | 12 | 40 | 35 |
| IBA | Cyclone11 | H+ | 11 | 120 | PIG | 42 | 13 | 52 | 35 |
| IBA | Cyclone18/9 | H−, (D−) | 18, 9 | 150 (40) | PIG | 42 | 25 | | 50 |
| IBA | Cyclone30 | H−, (D−) | 30, 15 | 1500 | Cusp | | 50 | | 180 |
| | | H−, (D−) | | 350 (50) (50) | | | | | |
| IBA | Cyclone70 | H2+, He++ | 30-70, 15-5 | (35) | | 66 (30) | 125 | | 350 |
| KIRAMS | KIRAMS-30 | H• | 15-30 | 500 | Cusp | 64 | | | |
| KIRAMS | Kotrun-13 | H+ | 40 | 100 | PIG | 77.3 | 20 | 80 | 187 |
| Siemens | EclipseRD | H− | 11 | 2 × 40 | PIG | | 11 | 39 | 35 |
| Siemens | EclipseHI/ST | H− | 11 | 2 × 40 | PIG | 72 | | | 35 |
| Sumitomo | HM-7 | H−, (D−) | 7.5, 3.8 | | | | | 30 | |
| Sumitomo | HM-10 | H−, (D−) | 9.6, 4.8 | | | | | 52 | |
| Sumitomo | HM-12/5 | H−, (D−) | 12, 6 | 60 (30) | PIG | 45 | 11 | 56 | 45 |
| Sumitomo | HM-18 | H−, (D−) | 18, 10 | 90 (50) | PIG | 45 | 24 | 86 | 55 |
| | | | | | | Average | 36 | 47 | 101 |

A second problem with PET isotope synthesis stems from the fact that materials prepared at the fixed cyclotron site lose specific activity during transport to the site where patients are scanned. This problem is particularly acute when the transport time t_transport is long compared to the decay time τ, because the specific activity drops by exp($-t_{transport}/\tau$).

A third problem results from the economics of producing the reagents at a central site. In order to spread the capital and operating costs of the facility many doses must be made at once, and these must be distributed in a timely manner to patients at dispersed locations. This complicates the logistics of patient care because scanning facilities must be choreographed with the production schedule of the cyclotron while accounting for material degradation in transit.

Yet another problem is that isotopes with very short lifetimes (small values of τ) cannot be used except in very close proximity to the accelerator because their specific activity degrades too rapidly to permit detection with useful signal to noise ratios in a PET scanner. For example, the half-life of $H_2{}^{15}O$, a PET tracer used to measure perfusion in cardiac imaging, is only 2 minutes.

Another problem is that production of multiple doses at once requires higher beam currents, which in turn demand windows between the vacuum and precursor regions that can manage thermo-mechanical stresses without significantly degrading the energy or current of the ion beam. A second problem with higher beam currents is collateral radiation damage to the chemical composition of the precursor. The irradiation of a large protein molecule containing nitrogen with large currents of $^{2}H^{+}$ ions from a cyclotron to synthesize $^{15}O$ radiolabels, for example, may degrade or denature the protein. This collateral damage limits the range of precursor materials to those that resist radiation damage, such as $H_2{}^{18}O$, one precursor for production of $^{18}F$ by proton beams.

Once a radionuclide is formed it can be chemically bound into a molecule that serves to mark specific molecular or biological activity. For example, $^{18}F$ is produced from $H_2{}^{18}O$ as aqueous $^{18}F^-$ anions that are converted through one or more chemical reactions to $^{18}F$-fluoro-deoxyglucose. This injectable reagent is taken up in vivo by cells and accumulates in their mitochondria, providing an indication of cellular metabolism rates. These chemical reactions and purifications are performed in heavily shielded enclosures or 'hot cells', named so due to the large amount of shielding required to prevent radiation exposure to the operators. The typical reaction volume of "hot cells" is of the order of 1 milliliter (mL) though the amount of radioactive atoms or molecules present is extremely small, typically $6\times10^{11}$ atoms or molecules. A typical processing time processing ($t_{process}$) is 40-50 minutes, that with the exception of $^{18}F$, exceeding by far the decay time of most interesting RN. The time and care required for this manual conversion contributes significantly to loss of specific activity in the final product.

Van Dam et al. disclosed a significant improvement in U.S. Pat. No. 7,829,032, entitled Fully Automated Microfluidic System for the Synthesis of Radiolabeled Biomarkers for Positron Emission Tomography, which is incorporated herein by reference in its entirety. Incorporating small-volume, automated processing substantially reduced the time required to convert radioactive precursors to injectable reagents, enabling higher specific activity and safer production than prior methods. However, a limitation of this approach is that it separates production of the radioisotope from chemical conversion, so the time to transfer radionuclides between a cyclotron and the microfluidic system ($t_{transfer}$), indicated schematically by (108) in FIG. 1, contributes to loss of specific activity according to equation (1).

U.S. Pat. No. 8,080,815 discloses use of microfluidic systems to synthesize radioactive tracers, which is incorporated herein by reference in its entirety. This reference discloses use of commercial micro-fluidic technology to process radionuclides created by a small cyclotron accelerator that separately produces radionuclide for one dose for human image needs, for example approximately 10 milli-Curie (mCi) for $^{18}F$-fluoro-deoxyglucose. This method suffers from all of the shielding and auxiliary deficiencies of electromagnetic accelerators, and also from the need to convey radionuclides from the cyclotron to the microfluidic reactor as indicated by (108) in FIG. 1.

Referring to FIGS. 3 and 4, charged particle accelerators have the following attributes: (1) an ion source system, (2) magnetic and/or electric fields that form and accelerate beams of single polarity charged particles with energy sufficient to undergo nuclear reactions, (3) a target for irradiation by the charged particle beams, and (4) a shielding system. Cyclotron accelerators were introduced in 1932 by E. O. Lawrence, who received the 1939 Nobel Prize for "the invention and development of the cyclotron and for results obtained with it, especially with regard to artificial radioactive elements." Cyclotrons and linear accelerators require a stream of particles of only one polarity because they use a combination of fixed and oscillatory electromagnetic fields that produce opposite forces on charges of different polarity. These beams are streams of particles whose center of mass moves with high velocity while its spread in energy, $\Delta E$, is smaller than its energy E ($\Delta E/E<<1$). Note that as $\Delta E$ approaches E the divergence of the beam increases, obviating further acceleration and directing toward targets. Cyclotrons have been widely used for production of radioisotopes and are commercially available, as summarized in Table II. However, the acceleration of the charged particles generates electromagnetic radiation that can damage electronics and is hazardous to human operators. These large, complex machines require kilowatts of electric power and many tons of radiation shielding. Moreover, the use of high voltages in vacuum requires careful shielding and insulation, contributing to the complexity and expense of conventional accelerators.

Efficient generation of radionuclides requires maximizing the integrated product of the velocity-weighted energy distribution $f(E)*v(E)$ with the cross section $Q(E)$ in equation 1 above. Another problem with accelerator-based radionuclide synthesis is that the resulting ion beams generally have energies well above that for which the radionuclide precursor has its maximum cross section. This in turn requires larger currents to increase the production rate, concurrently increasing collateral radiation damage to the precursor materials.

Accordingly, there exists a need for additional devices and methods for production of radioactive reagents, and in particular, devices and methods that avoid the aforementioned limitations. Such devices and methods would be particularly useful in nuclear medicine, including positron emission tomography.

SUMMARY

Disclosed herein are methods and apparatus for portable production of radiolabeled chemical compounds for use in nuclear medicine, radiology, and medical imaging. The methods use a directed jet of quasi-neutral plasma to activate precursor materials that undergo nuclear reactions and produce radionuclides. The radionuclides can be subsequently converted to radiolabeled compounds (e.g., radionuclides can be converted by microfluidic reactions and purifications to an injectable radioactive reagent).

The plasma jet can be produced by firing a sub-picosecond laser pulse with peak power greater than about one terawatt and less than about thirty terawatts at a solid, liquid, or gaseous target in vacuum. The jet can be directed by target normal sheath acceleration through a window onto a solid, liquid, or gaseous precursor that undergoes nuclear reactions to produce radionuclides. The irradiated precursor can be contained in a disposable reusable cartridge that converts the radiolabeled precursor into injectable reagent using standard microfluidic chemical reactions and purifications. The wavelength, pulse duration, focus, and energy of the laser, as well as the density gradients, composition, and orientation of the target can be selected to produce a plasma jet whose ion energy distribution substantially overlaps the cross-section for nuclear transformation of the precursor to a desired radionuclide.

The apparatus can have dramatically smaller size, weight, power, shielding requirements, and operating costs than prior systems, thereby allowing portable devices that can be located proximate to the patient and imaging scanner. The disclosed methods and apparatus moreover can relieve the logistical burden of transporting radioactive materials and scheduling patients, and provide radioactive probes with higher specific activity and shorter half-lives to be used in nuclear medicine and medical imaging. These and other advantages of the method and apparatus will be apparent from the detailed description below.

DETAILED DESCRIPTION

Figure 1:
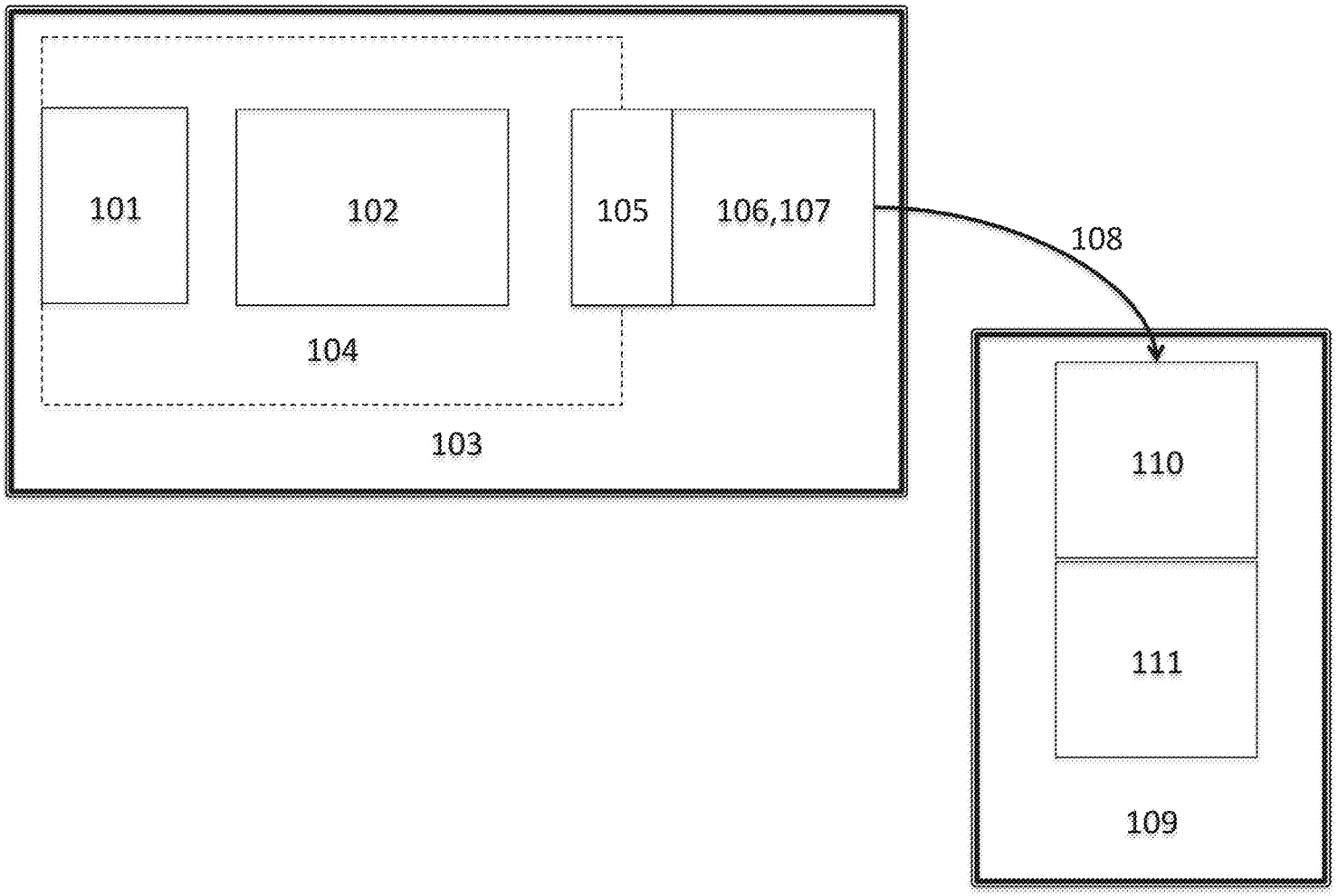
FIG. 1 presents a schematic view of prior art methods for synthesis of radiochemical using charged particle accelerators and transfer to a chemical or microfluidic reactor.

The present disclosure relates to methods and devices for synthesizing radiochemical compounds. The methods include generating a quasi-neutral plasma jet, and directing the plasma jet onto a radionuclide precursor to provide one or more radionuclides. The radionuclides can be used to prepare radiolabeled compounds, such as radiolabeled biomarkers.

The methods and devices can use a quasi-neutral plasma jet impinging through a window onto a precursor in a microfluidic reactor for subsequent chemical reactions and purifications. The plasma jet can be produced by target normal sheath acceleration created by a light pulse interacting with a dense solid, liquid, or gaseous target. This can eliminate the need for conventional accelerators, reducing the size, weight, power, and shielding requirements, and enabling portable production of and access to short-lived radioisotopes for biomedical imaging and radiology.

Definition of Terms

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

The conjunctive term "or" includes any and all combinations of one or more listed elements associated by the conjunctive term. For example, the phrase "an apparatus comprising A or B" may refer to an apparatus including A where B is not present, an apparatus including B where A is not present, or an apparatus where both A and B are present. The phrases "at least one of A, B, . . . and N" or "at least one of A, B, . . . N, or combinations thereof" are defined in the broadest sense to mean one or more elements selected from the group comprising A, B, . . . and N, that is to say, any combination of one or more of the elements A, B, . . . or N including any one element alone or in combination with one or more of the other elements which may also include, in combination, additional elements not listed.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

The term "pre-pulse light," as used herein, may refer to light that arises from amplified spontaneous emission whose intensity is less than about $10^{-4}$ times that of the main pulse. The energy in the pre-pulse can be spread out over much longer times and may cause ionization of target material that interferes with TNSA. There are two types of pre-pulses: (1) pedestal—duration of a few to tens of picoseconds—since this is long compared to the light pulse its intensity is comparatively small; and (2) leakage from a regenerative amplifier whose duration is slightly longer than the light pulse so its relative intensity is $10^{-6}$ to $10^{-8}$.

Methods and Apparatus

Figure 2:
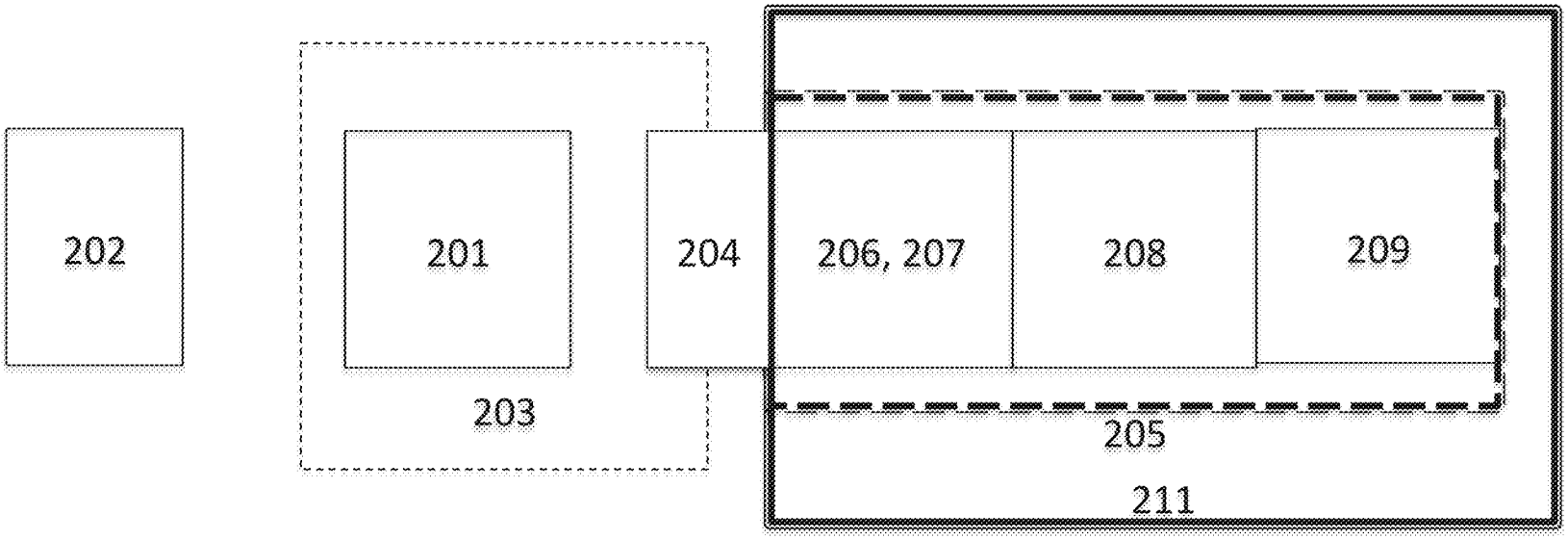
FIG. 2 presents a schematic view of a method and apparatus using a laser-driven quasi-neutral plasma delivered directly into a microfluidic reactor.

Radionuclides can be created by bombardment of a precursor with a quasi-neutral plasma jet, and in particular, a quasi-neutral plasma jet that contains a significant flux of positive ions with an energy distribution f(E) that spans the cross section Q(E) of the relevant nuclear reaction. Referring to FIG. 2, the plasma jet can be produced by irradiating a solid, liquid, or gaseous target (201) with a sub-picosecond light pulse from a light source (202) whose energy, wavelength, pulse-shape, and focus are selected to control f(E) for ions in the resulting plasma. In certain embodiments, only the target (201) is contained in a vacuum chamber (203). The plasma can be directed through a thin foil or window (204) directly into a microfluidic cartridge (205) that contains radionuclide precursor (206). The resulting radionuclide (207) can be subjected to microfluidic reactions (208) and purifications (209) to produce an injectable PET reagent. In certain embodiments, no transfer of radionuclide to a separate reactor is required, as indicated for previous approaches by the arrow (108) in FIG. 1. Only one lightweight shield (211) for the radioactive decay products of the radionuclide may be required. No heavy shielding may be required, and in particular, no heavy shielding (103) that protects from radiation produced in the accelerator. In certain embodiments, the microfluidic cartridge (205) is disposable and produces a single dose of reagent.

The disclosed methods do not require isolation of charged particles with one polarity. The absence of an electromagnetic accelerator can reduce the size, weight, power, and shielding requirements for the system to the point that it can be portable. Since the synthesis of the PET reagent can occur proximate to the patient, the contribution of $t_{transport}$ to the decay of specific activity is reduced or eliminated.

Figure 3:
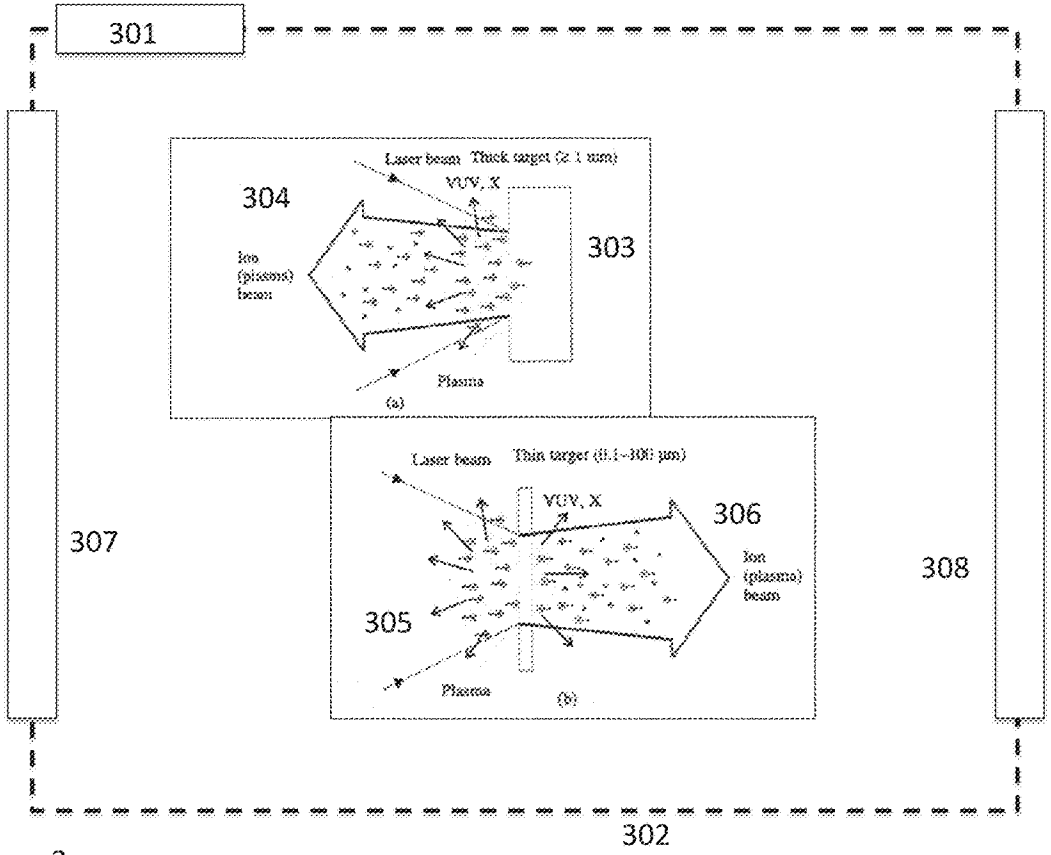
FIG. 3 shows the arrangement of the light pulse, quasi neutral plasma jets, and windows through which the jets pass from vacuum to impinge on a radionuclide precursor.

Referring to FIG. 3, quasi-neutral plasma jets (304,306) may be generated on either or both sides of an illuminated target. The light pulse may enter through optical window (301) on the left side of the vacuum chamber (302) and strike the left face of the targets (303, 305). If the target (303) is thicker than about 1 millimeter, the primary direction of the plasma jet (304) is to the left in FIG. 3. If the target (305) is thinner than about 100 microns, then the primary direction of the plasma get (306) is to the right. Accordingly, one or more foils or windows (307, 308) that are transparent to these plasma jets can be placed between the targets, held under vacuum, and the radionuclide precursor, which is held at pressures greater than about 100 kPa.

Figure 4:
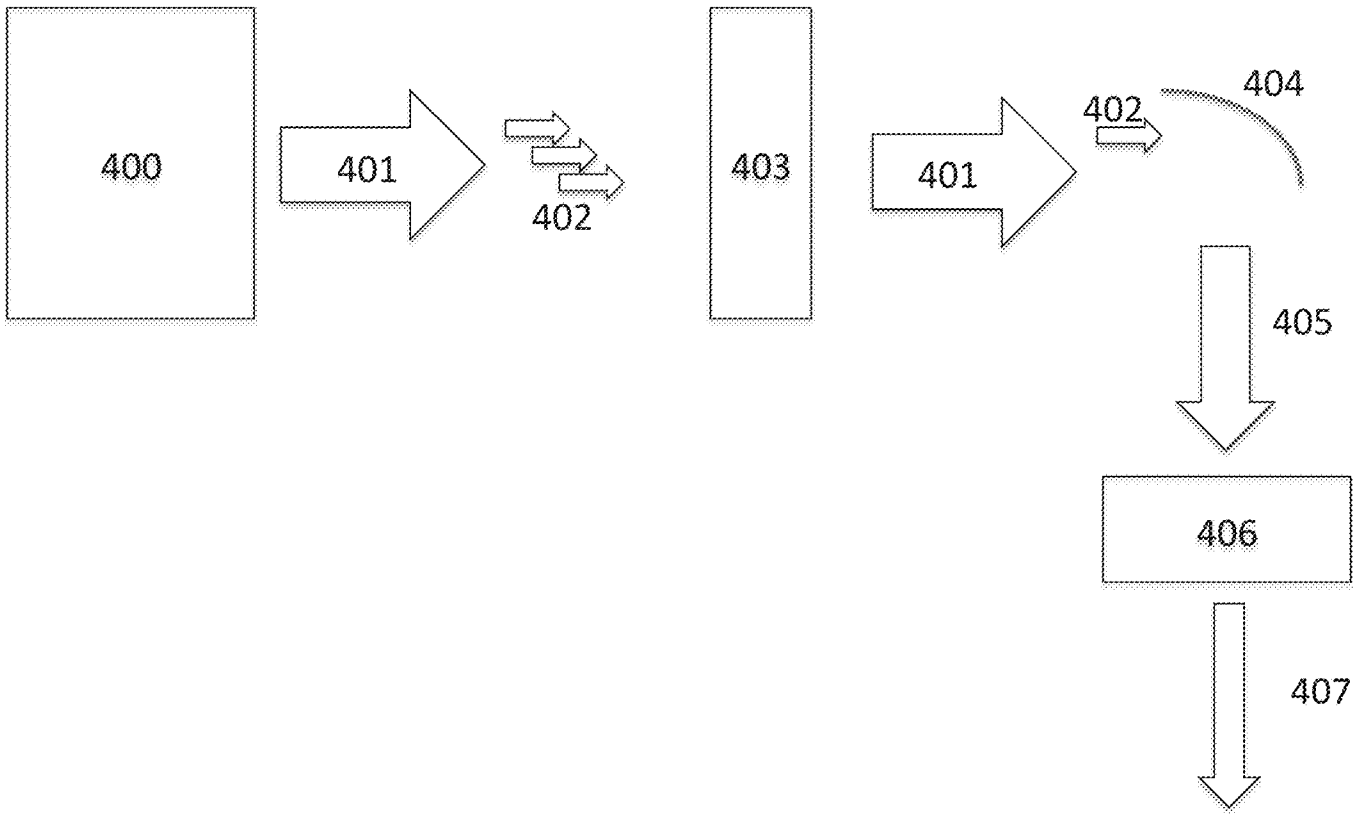
FIG. 4 illustrates the use of one or more sacrificial foils, plasma mirrors, and plasma lenses to shape the temporal and spatial feature of a main light pulse before it strikes the target.

FIG. 4 shows details of an exemplary pulsed light source. The pulsed light source (400) produces a primary pulse (401) that is preceded by one or more lower energy pre-pulses (402). In order to prevent light with energy of more than about $10^{-10}$ times that of the light pulse, sacrificial thin foils (403) or plasma mirrors (404) that absorb this pre-pulse energy may be configured between the light source and the target. Plasma mirrors (404) may be shaped to focus the primary light pulse, as indicated by the arrows labeled (401) and (405) in FIG. 4. Plasma lenses (406), created by pulsed irradiation of a region through which the main light pulse subsequently passes, may also be arranged to further focus the light onto the target, as indicated by the arrows labeled (406) and (407). These plasma lenses have the advantage that they are not damaged by the high intensity of the light pulse; in contrast to conventional solid refractive or reflective optics. Properties of plasma lenses are described in *A plasma microlens for ultrashort high power lasers*, by Yiftach Katzir, Shmuel Eisenmann, Yair Ferber, Arie Zigler, and Richard F. Hubbard, Applied Physics Letters 95, 031101 (2009), which is incorporated herein by reference in its entirety. The plasma lens selectively refocuses lower intensity or pre-pulse light to further reduce its intensity at the target while retaining the focus of the ($\alpha$>1) light pulse at the target. The light pulse with minimal ($<10^{-10}$) contributions from pre-pulses (407) is focused onto the target to produce the quasi-neutral plasma jet.

Figure 5:
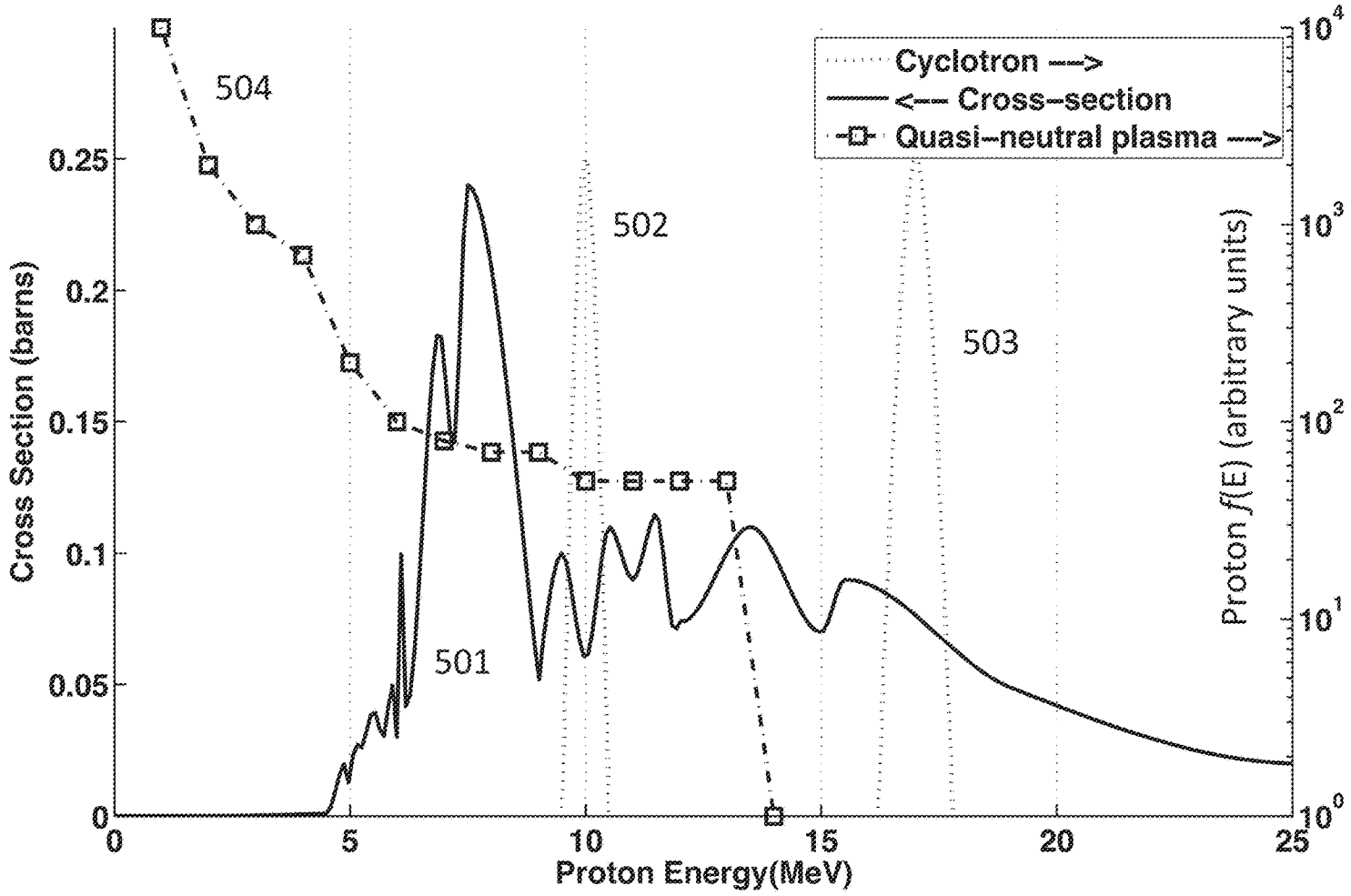
FIG. 5 shows the cross-section for the nuclear reaction $^{14}N+^{1}H \rightarrow ^{11}C+^{4}He$ as a function of collision energy (left, linear scale), the energy distributions f(E) for protons produced by 10 MeV and 17 MeV cyclotrons, and the energy distribution for the quasi-neutral plasma source (right, logarithmic scale).

One example of optimizing production according to equation 1 refers to FIG. 5. The cross section for the reaction $^{14}N+^{1}H\rightarrow^{11}C+^{4}He$ (501) refers to the left, linear abscissa, while the narrow energy distributions f(E) at 10 MeV (502) and 17 MeV (503) that are produced by an linear or cyclotron accelerator and the broader f(E) produced by the quasi-neutral plasma (504) are shown with the logarithmic abscissa on the right side of the graph. Manipulation of the distribution function $f(E)$ by judicious choice of the light source and plasma target parameters provides flexibility in optimizing the integrand of Equation 1 that is not possible for accelerator produced beams, whose only adjustable parameter is the charged particle beam energy.

A first step may include converting the energy of short, high power pulses of light to energetic plasma jets by bombarding thin material targets. Coherent light sources that generate ultra-short (0.03-2 picoseconds), high power ($>10^{18}$ Watts/cm$^2$) pulses in the wavelength range of 0.5-10 nm and experiments using them to bombard targets revealed that judicious choice of the laser and target parameters converts photon energy to quasi-neutral energetic jets of plasmas with controlled ionic content. The fundamental physical process, known as Target Normal Sheath Acceleration (TNSA), converts pulses of light to energetic, quasi-neutral plasma jets with hot electrons (temperature of several Mega-Electron Volts (MeV)) and protons with energy up to 30 MeV. These plasma jets have high brightness ($>5\times10^{10}$ protons per pulse), small virtual source size (<1 μm), low emittance (0.005π mm·mrad) and conversion efficiency of light energy to multi-MeV protons between 1-10%. Machi, in Superintense Laser-Plasma Interaction Theory Primer, Springer Briefs in Physics, (New York: Springer Verlag, 2013), summarizes the experimental and theoretical developments of converting light to quasi-neutral plasma jets, the disclosure of which is incorporated herein by reference in its entirety.

TNSA can include two steps. A first step comprises the almost instantaneous ionization and formation of quasi-neutral plasma with electrons whose temperature substantially exceeds that of the heavier positive ions. An important parameter for TNSA is the ratio of the maximum plasma density n to the critical density of the plasma $n_c$, defined on the basis of the laser parameters as $n_c=1.1\times10^{21}\lambda^{-2}$ cm$^{-3}$, where $\lambda$ is the laser wavelength in microns (μm). The critical density is the plasma density at which the laser frequency equals the electron plasma frequency. Experiments and theory have established that, for subcritical interactions, when $n<n_c$, the target is transparent to radiation and very little laser energy is transferred to the plasma. Optimal coupling occurs for values equal to or slightly above $n_c$. Another important parameter that controls the conversion of light energy to energetic plasma jets is the value of the dimensionless vector potential, $\alpha_0$, $=0.6\lambda\sqrt{I}$, where I is the laser intensity in units of $10^{18}$ W/cm$^2$ and $\lambda$ is the laser wavelength in μm. The parameter $\alpha_0$ represents the ratio of the oscillatory momentum of the plasma electrons in the presence of the laser field to $m_oc$. The electron temperature $T_e$ is of the order of the cycled averaged oscillation energy in the electric field of the laser light in vacuum and is given by $$T_e = m_o c^2\left(\sqrt{1+\frac{1}{2}a_o^2}-1\right)$$

Values of $\alpha_o$ larger than unity imply that the temperature of the electrons $T_e$ exceeds one MeV. Computer simulations and experiments indicate that the distribution function of the hot electrons $f_e$ has the form:

$$f_e(E) \sim e^{-\left(\frac{E-T_e}{0.6T_e}\right)^2}$$

Figure 6:
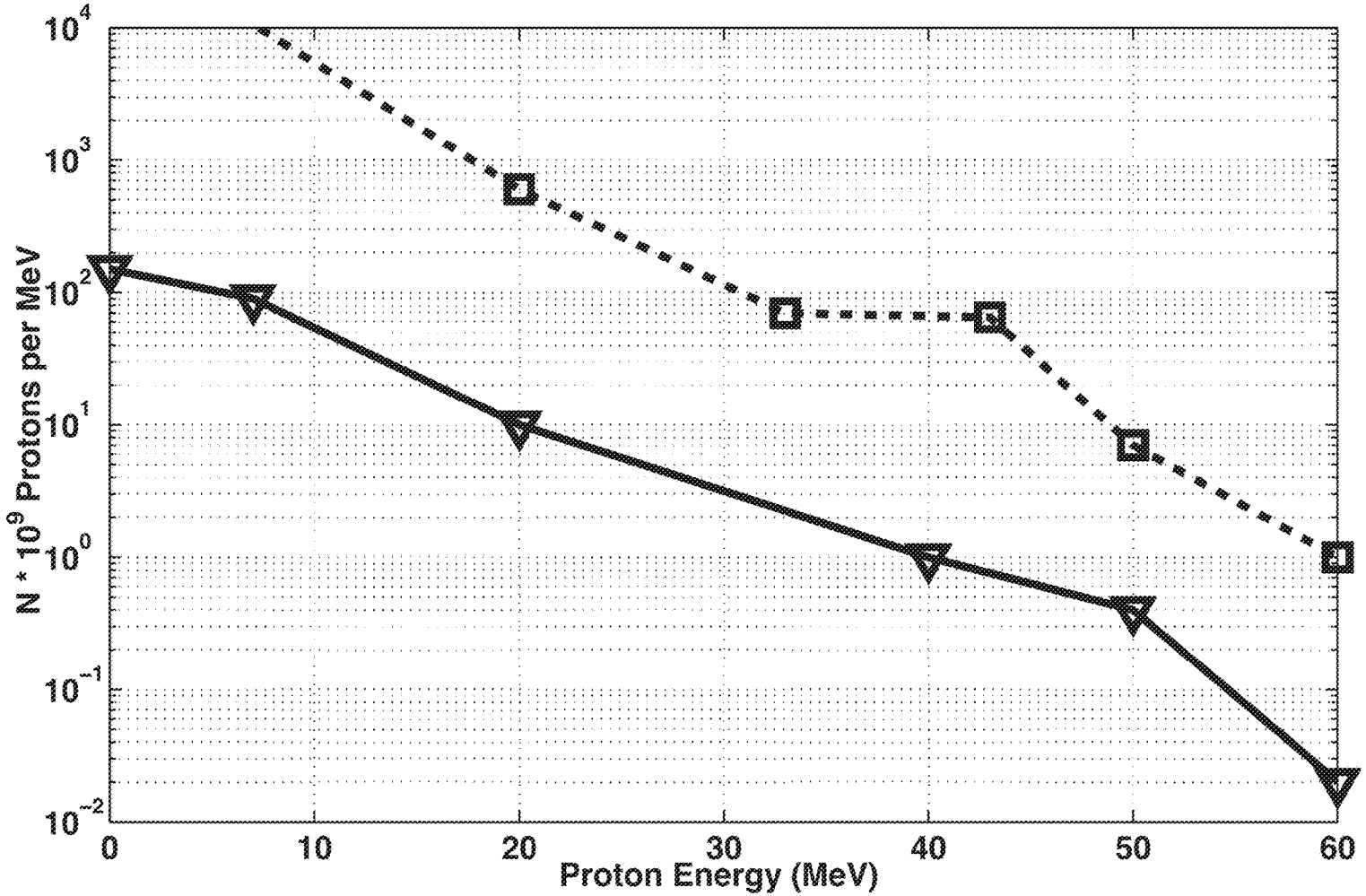
FIG. 6 shows experimentally measured proton fluxes for irradiation of a solid hydrocarbon target with a 1 μm laser and $I=4\times10^{20}$ W/cm$^2$ ($\alpha_o \approx 10$). The flux coming from the illuminated face of the target (squares), is significantly larger than from the other side (triangles).

The second step involves expansion of the hot electrons into the vacuum surrounding the thin target, producing a transient electrostatic sheath. Quasi-neutrality is quickly restored by transferring energy from the hot electrons to the ions. Self-similar solutions confirmed by experiments indicate formation of a quasi-neutral energetic plasma jet containing ions with energy up to 10 $T_e$ follows charge neutralization. FIG. 6 shows the experimental proton flux measured by Snavely et al. [Phys. Rev. Lett., 85, 2945, 2000] from a flat, 100 μm thick, hydrocarbon polymer target irradiated with a 1 μm laser whose peak intensity was $3\times10^{20}$ W/cm$^2$, corresponding to a value of $\alpha_o\approx10$. The interaction created proton-dominated plasma jets on both sides of the target with energy up to 60 MeV and conversion efficiency of light to fast plasma jets of 10%. This flux was directed normal to the target with angular width close to 10 degrees. This and other experiments and theory gave proton energy spectra $f(E)\sim e^{-E/T_e}$.

In certain embodiments, a short laser pulse can be impinged onto solid targets to produce a quasi-neutral plasma jet with an ion energy distribution falling between about 1 and about 15 MeV. Examples of a solid target include polymeric or metallic foils with adsorbed moisture, hydrogen, deuterium, or molecules containing hydrogen, thin metallic targets upon which one or more, less dense "foam" layers are deposited [Sgattoni et al., Physical Review E85,036405, 2012] and "limited mass targets" [Buffechoux et al, Physical Review Letters 105, 015005, 2010] with surface area smaller than $10^4$ μm$^2$ and thickness less than 10 μm.

In certain embodiments, a short laser pulse can be focused onto a liquid film or liquid droplet to produce a quasi-neutral plasma jet. The liquid composition and optical thickness are chosen so as to maximize the plasma density gradient following irradiation, which in turn produces optimal target normal sheath interactions.

In certain embodiments, a short laser pulse can be impinged onto a pulsed gas jet. This composition of the gas jet is chosen to produce specific ions of, for example, $H^+$, $D^+$, or $He^+$. A second requirement for the gas jet is that it have sufficient optical and mass density to produce plasmas with $n>n_c$ and sharp gradients in the plasma density following the first few femtoseconds of the irradiation. In order to achieve these conditions, the backing pressure behind the pulsed valve from which the jet is formed preferably exceeds 100 kPa, and more preferably is greater than 10 MPa. A sub millimeter diameter pulsed gas jet device described by Sylla et al. [Review of Scientific Instruments, 83, 033507,2012] produces pressures of 30-40 MPa, enabling TNSA under overcritical or critical conditions and facilitating control of the plasma density gradients.

Many pulsed light sources produce optical radiation that precedes the light pulse. This 'pre-pulse' radiation can interact with the target and interfere with TNSA. In certain embodiments, one or more plasma mirrors [Monot et al., Optics Letters, 29, 8093,2004; Buffechoux et al. Physical Review Letters 105, 015005, 2010] can be utilized to preferentially absorb this radiation and to thereby increase the ratio of energy in the light pulse to that preceding the light pulse, also known as pre-pulse contrast, above $10^{10}$.

In certain embodiments, plasma microlenses [Kazir et al., Applied Physics Letters, 95,031101, 2009; Nakatsutsumi et al., Optics Letters 35, 2314, 2010] can be used to increase the light intensity on the target by about a factor of 10 and to achieve extremely low focal f-numbers. This can increase the conversion efficiency of light to plasma jets and can reduce the diameter of the plasma target chamber to less than about 15 cm, enabling the system size and weight to be substantially less than prior art cyclotrons and linear accelerators.

Recognizing that ions produced by TNSA are emitted in the direction normal to the target surface, whether the target is flat or has curvature, the quasi-neutral plasma jet can be focused by appropriately shaping the target surface, for example by the use of a concave or spherical target. Ion beams produced by traditional accelerators are strongly defocused by the Coulomb force between ions, requiring strong electrostatic and magnetic fields to collimate and direct the ions. The disclosed plasma jets are quasi-neutral and can be focused with relative ease. Focusing from a curved target was demonstrated experimentally, where the plasma jet intensity increased by an order of magnitude when spherical, rather than flat, thin foil targets were used. [Kaluza et al., Phys. Rev. Lett., 93, 045003-1-4 (2004)]. The same logic applies to liquid and gas jet targets, where the geometric shape of the target density profile can be chosen to focus the quasi-neutral plasma jet.

The light pulse may be generated by commercial Ti:sapphire laser systems with appropriate optics, such as the Amplitude Technologies TT-Mobile system. [http://www.amplitude-technologies.com]. Alternative methods for producing sub-picosecond optical pulses with minimal pre-pulse energy including fiber amplifiers, Nd:YAG amplifiers, optical parametric chirped-pulse amplifiers, and the like are familiar to those practiced in the art of laser physics and may be used so long as the value of $\alpha_0$ is greater or equal to 1.

The laser pulse energy, duration, and wavelength are chosen to produce a quasi-neutral plasma whose energy distribution f(E) maximizes the production rate of radionuclide from the specific solid, liquid, or gaseous target based on their cross-sections Q(E) in accordance with equation 1. Examples of controlling f(E) and the efficiency of TNSA by combinations of laser energy, pulse shape, transient plasma lenses and mirrors, and various target compositions with pulsed light sources are shown in FIGS. 6 through 10.

FIG. 6 shows the flux and energy of protons produced from a 100 μm thick hydrocarbon film by TNSA with $\alpha_o\approx10$. The flux and energy emerging from the illuminated side of the target (squares) was about a factor of twenty larger than the plasma jet emerging from the target's other side (triangles). [Snavely et al. Phys. Rev. Lett., 85, 2945, 2000].

The proton flux induced by the hydrocarbon target was five times larger than for the gold target. Analysis and simulations indicate that the ionic component of the energetic plasma jets has three different origination channels: from the rear side to the forward direction, from the front side to the forward direction, and from the front side to the backward direction. The efficiency and energy of the plasma jet depend strongly on the sharpness of the density gradient [Mackinnon et al. Physical Review Letters 86,1769, 2001]. In most of the early experiments the sharpest density gradient occurred on the illuminated side of the target thereby generating a dominant plasma jet in the backward direction.

Figure 7A:
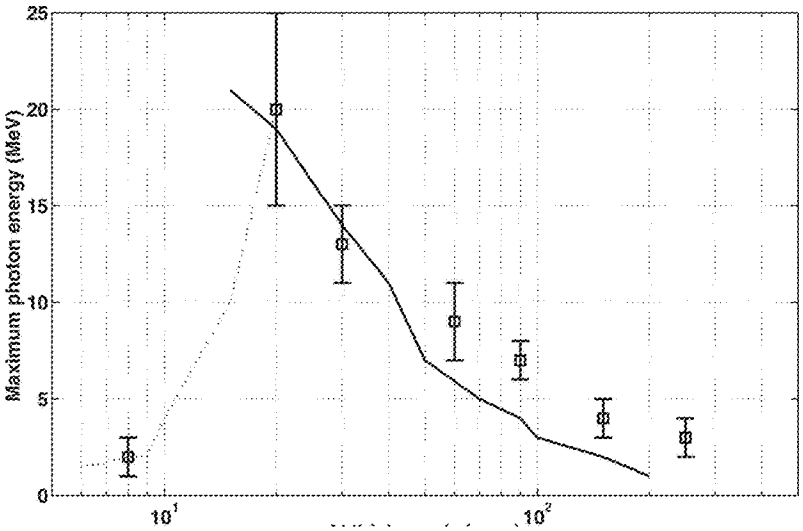
FIG. 7 shows (a) the maximum proton energy, and (b) the laser-proton energy conversion (calculated for protons with energy >4 MeV) for constant laser conditions (pulse width=320 fs and $I=4\times10^{19}$ W cm$^{-2}$) and various Al foil thicknesses.
Figure 7B:
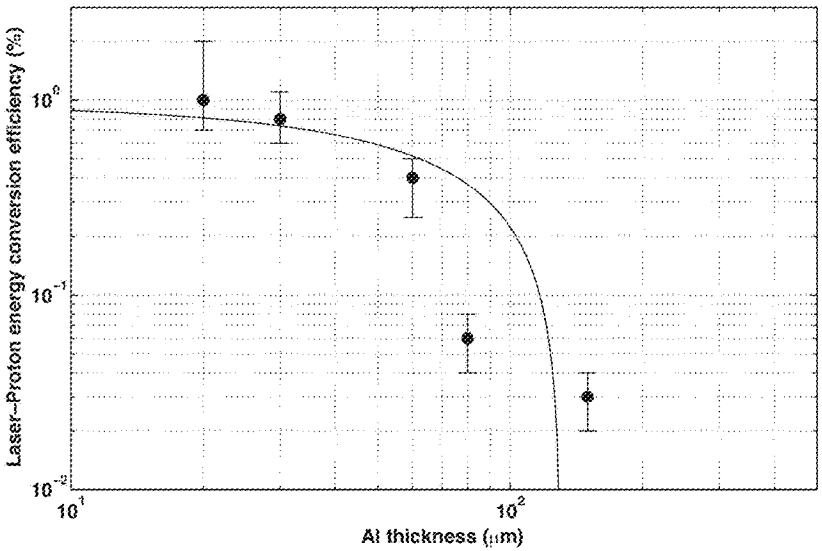
Figure 8:
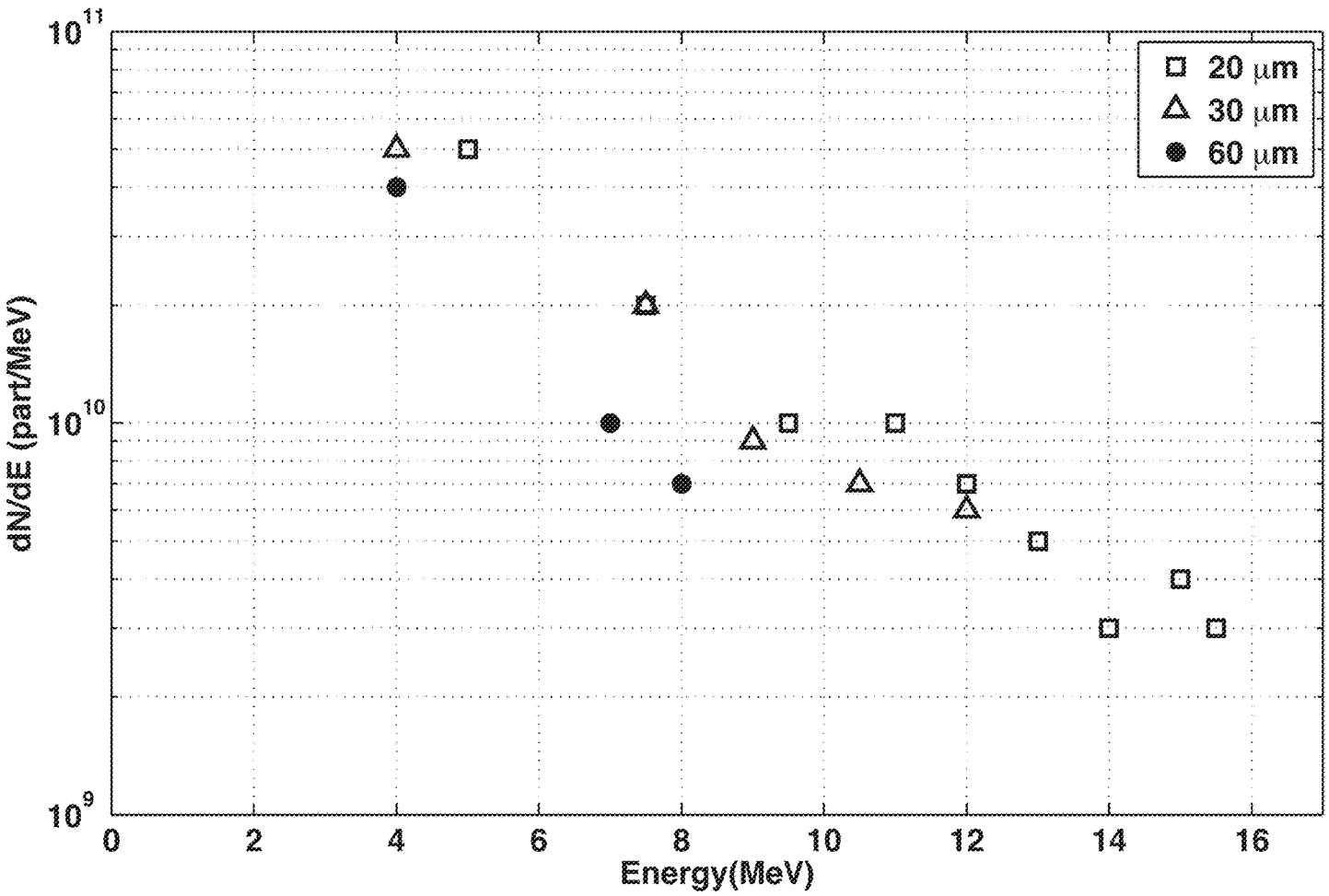
FIG. 8 shows the proton energy distribution function $f(E)$ for three different values of Aluminum foil target thickness, A, produced by 350 fsec irradiation with $I=3\times10^{19}$ W/cm$^2$ at $\lambda=0.8$ μm.

The influence of target thickness on TNSA has been elucidated. Referring to FIG. 7, experiments by Fuchs et al., [Nature Physics, 2, 48 2006] show that thin targets are more efficient convertors of light to energetic plasma jets than thick targets. [Borghesi et al. Phys Rev Lett., 92, 055003, (2004)] demonstrated, as shown in FIG. 8, that the value of f(E) can be significantly controlled by the target thickness. These plasma jets whose proton energy distribution function $f(E)$ is shown in FIG. 8, have low emittance (0.1 $\pi$ mm·mrad at 15 MeV). This obviates the need for collimation of the plasma beam by electrostatic lenses, as previously necessary.

FIG. 7 also shows the scaling of the maximum proton energy and efficiency with target thickness that favors thinner targets down to 20 μm thickness. The laser pre-pulse destroyed the sharpness of the density gradient at the back surface for channels thinner than 10 μm.

Figure 9:
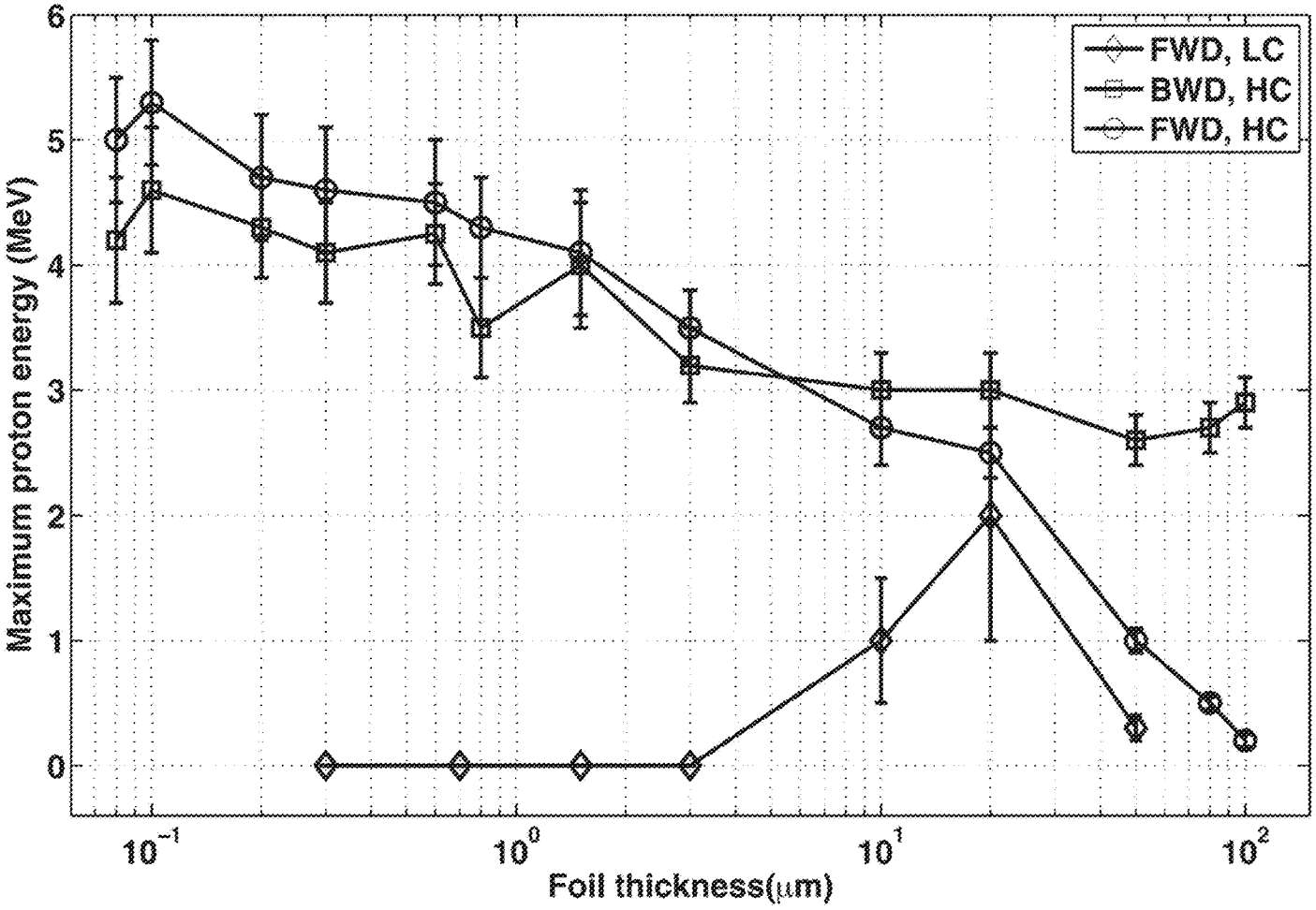
FIG. 9 shows the variation of maximum detectable proton energy as a function of target thickness in the direction of the $5\times10^{18}$ W/cm$^2$ laser pulse, (FWD), and opposing it, (BWD), for (pre-pulse:light pulse) intensity ratios of $10^{-6}$ (low contrast, LC) and $10^{-10}$ (high contrast, HC)
Figure 10A:
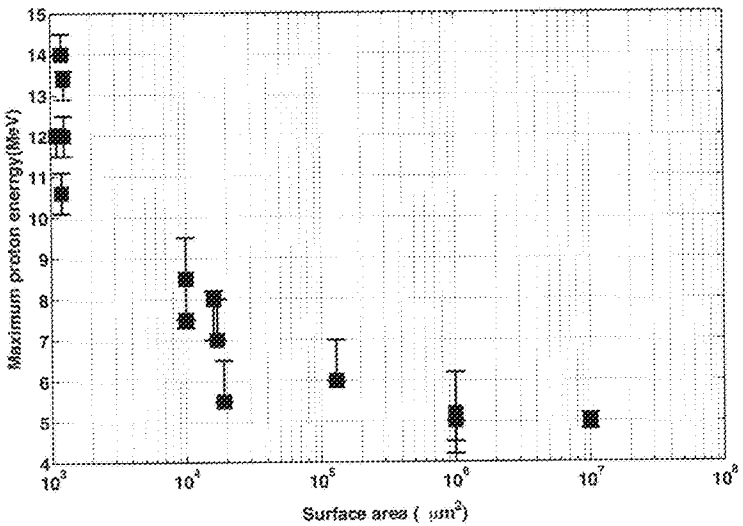
FIG. 10 shows (a) maximum proton energies for a 2 μm thick Au targets with various surface areas and (b) laser-to-proton energy conversion efficiencies for protons whose energy exceeds 1.5 MeV for the same targets.
Figure 10B:
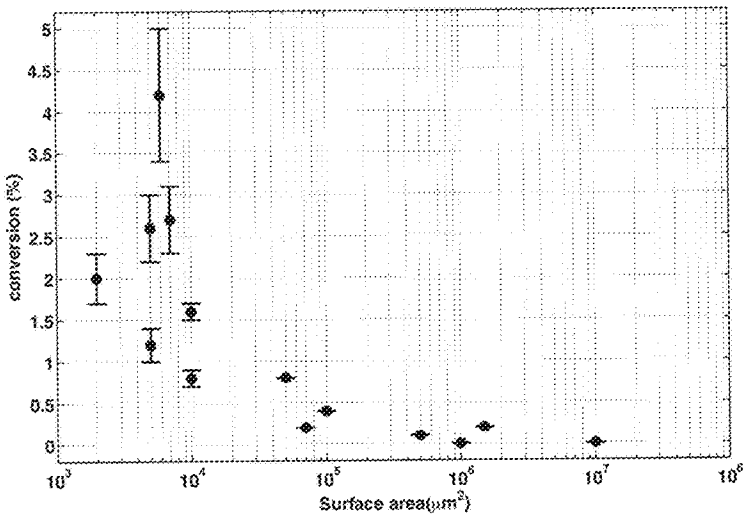

The understanding of the role of the laser pulse shape led to the development of additional scaling laws. First, experiments [Ceccotti et al., Physical Review Letters, 99, 185002, 2007] discovered that the maximum energy and the conversion efficiency continue to increase for target thickness smaller than 10 μm, as long as the contrast between laser pulse and its pre-pulse is very large. These results are shown in FIG. 9. More than three-fold increase in maximum energy with half the laser intensity has been demonstrated by using targets as thin as 0.1 μm. In these very thin targets the forward and backward plasma jet are symmetric. As shown in FIG. 10, [Buffechoux et al, Physical Review Letters 105, 015005, 2010] demonstrated that decreasing the surface target area dramatically increases both the conversion efficiency and the maximum proton energy. For example, reducing the surface area from $10^7$ to $2\times10^3$ $\mu m^2$ increases the efficiency by a factor of 30, to 4%, while increasing the maximum proton energy by a factor of 3 to 14 MeV, for a 2 μm thick target and $I\approx2\times10^{19}$ W/cm$^2$. The fundamental reason for the efficiency increase is confinement of the hot electrons by reflection from the edges of the target that increases both the number density and temperature of the hot electrons.

These and other considerations provide control of f(E) and light to plasma jet conversion efficiency through changes in the geometry, phase (solid, liquid, or gas), and dimensions of the target as well as the focus, energy, pulse shape, and wavelength of the light source.

The precursor material, a non-limiting example being $H_2{}^{18}O$, can be exposed to the plasma jet through a suitable window material. Since the plasma is formed in a vacuum and the precursor is a condensed or gaseous phase with non-zero pressure, a material that is transparent to and undamaged by the quasi-neutral plasma and that does not leak or fail from the pressure difference between the precursor and the vacuum chamber is preferred. Transparent materials preferably have average atomic numbers less than about 12, for example poly-p-phenylene-benzo-bis-oxazole (PBO), or an aramid such as Kevlar™ which contain only C, H, O, and N. PBO and Kevlar are non-limiting examples of materials with large elastic moduli (315 GPa and 125 GPa, respectively) and tensile strengths, as well as low gas permeabilities. A thin film or foil of these and similar materials can provide an impermeable barrier between the precursor at high pressures and the plasma jet in the vacuum chamber while being transparent to the MeV ions and electrons that comprise the plasma jet.

In certain embodiments, radionuclides are formed directly in the microfluidic reactor that subsequently transforms the radionuclide into an injectable reagent through chemical reactions and purifications. This can eliminate the time required to transfer ($t_{transfer}$) radionuclides formed in cyclotrons to hot cells or microreactor systems, thereby increasing the specific activity of the product.

In certain embodiments, a reusable or, preferably, a disposable sterile microfluidic cartridge is provided that contains the window, precursor, and other chemical materials to complete transformation of a quasi-neutral plasma flux into an injectable reagent. Individual doses of various nuclear probe molecules can be conveniently prepared from the same system without requirements for cleaning, radioactive decontamination, or sterilization.

The ability to prepare useful quantities of short-lived radioisotopes incorporated into arbitrary molecular compositions gives rise to further embodiments in non-destructive testing of materials and systems, tagging, tracking, and locating, and other non-medical applications.

It is understood that the foregoing detailed description and accompanying examples are merely illustrative and are not to be taken as limitations upon the scope of the invention, which is defined solely by the appended claims and their equivalents. Various changes and modifications to the disclosed embodiments will be apparent to those skilled in the art.

What is claimed is:

1. A method for production of radioisotopes, the method comprising:

directing a light pulse along an optical axis to generate a quasi-neutral plasma jet in the absence of an electromagnetic accelerator; and directing, in the absence of an electromagnetic accelerator, the quasi-neutral plasma jet in a direction collinear with the optical axis onto a radionuclide precursor.

2. The method of claim 1, where the quasi-neutral plasma jet is produced by impinging a light pulse less than about $10^{-11}$ seconds in duration onto a target material;

wherein the dimensionless vector potential of the light pulse, $\alpha_o=0.6\lambda\sqrt{I}$, is greater than about one, where $\lambda$ is the wavelength in μm and I is the intensity in units of $10^{18}$ W/cm$^2$.

3. The method of claim 2, where the target material is a solid film or particle; or the target material is a liquid film, jet, or droplet.

4. The method of claim 2, where the target material is a gas jet whose number density in the focal region of the light pulse is greater than about $10^{20}$ nuclei per cubic centimeter.

5. The method of claim 2, where the light pulse is preceded by one or more pre-pulses whose dimensionless vector potential $\alpha_o<10^{-4}$.

6. The method of claim 2, where the light pulse is produced by a laser having a wavelength of about 0.4 μm to about 20 μm.

7. The method of claim 2, where the light pulse is preceded by one or more pre-pulses whose dimensionless vector potential $\alpha_o<10^{-10}$.

8. The method for production of radioisotopes, comprising:

generating a quasi-neutral plasma jet; and directing the quasi-neutral plasma jet onto a radionuclide precursor, where the quasi neutral plasma jet passes from an evacuated region through a window to interact with the radionuclide precursor at a region of higher pressure.

9. The method of claim 8, wherein the evacuated region is at a pressure of 37 Pascal (Pa) or less; and the region of higher pressure is at a pressure of about 100 kPa to about 10 MPa.

10. The method of claim 8, wherein the region of higher pressure is at a pressure of about 100 kPa.

11. The method of claim 8, where the window material has an average atomic number less than about 14 and thickness small enough to ensure >90% transparency to the plasma jet.

12. The method of claim 8, wherein the window has a thickness of about 0.1 millimeter to about 0.5 mm.

13. The method of claim 8, where the window material has an elastic modulus of greater than 1 GPa.

14. The method of claim 8, wherein the window material supports the pressure of the high pressure region with less than about 1% strain.

15. The method of claim 8, where the window material comprises poly-paraphenylene terephthalamide (Kevlar) or poly-p-phenylene benzo-bis-oxazole (Zylon).

16. The method of claim 8, where the radionuclide precursor is a liquid contained in a channel or capillary of a microfluidic reactor.

17. The method for production of radioisotopes, comprising:

generating a quasi-neutral plasma jet; and directing the quasi-neutral plasma jet onto a radionuclide precursor, where the energy distribution of the ions in the quasi-neutral plasma jet, f(E), is chosen to maximize the rate of radioisotope production for a process with a cross-section Q(E) according to the formula:

$$\frac{d[RN]}{dt} = [\text{Precursor}] * \int Q(E) * f(E) * v(E) dE$$

where [RN] is the concentration of radionuclide, [Precursor] is the concentration of precursor, and v(E) is the center-of-mass velocity for the nuclear reaction that converts Precursor to RN.

18. The method of claim 17, wherein the energy distribution f(E) is a monotonically decreasing function of energy.

19. The method of claim 17, wherein the concentration of precursor is $10^{20}$ $cm^{-3}$ or greater.

* * * * *